United States Patent [19]

Fremont et al.

[11] Patent Number: 4,729,080

[45] Date of Patent: Mar. 1, 1988

[54] SLOPED CEILING RECESSED LIGHT FIXTURE

[75] Inventors: Robert S. Fremont, Deerfield; Joseph B. Stauner, Crystal Lake, both of Ill.

[73] Assignee: Juno Lighting, Inc., Des Plaines, Ill.

[21] Appl. No.: 8,270

[22] Filed: Jan. 29, 1987

[51] Int. Cl.[4] ..... F21V 17/00

[52] U.S. Cl. ..... 362/366; 362/148; 362/287; 362/365

[58] Field of Search ..... 362/147, 148, 287, 364, 362/365, 366, 372

[56] References Cited

U.S. PATENT DOCUMENTS

| | | | |
|---|---|---|---|
| 2,716,185 | 8/1955 | Burliuk et al. . | |
| 2,922,030 | 1/1960 | Bobrick | 362/366 |
| 3,182,187 | 5/1965 | Gellert . | |
| 3,313,931 | 4/1967 | Klugman | 362/366 |
| 3,381,123 | 4/1968 | Docimo . | |
| 4,314,223 | 2/1982 | Kristofek . | |
| 4,400,673 | 8/1983 | Gilman . | |
| 4,450,512 | 5/1984 | Kristofek . | |

OTHER PUBLICATIONS

Catalog entitled "Caprilighting,"-cover, pp. 5-13, and back listing a copyright date of 1984.

Brochure entitled "Caprilighting Buyers Guide Effective Mar. 1, 1985,"-cover and p. 20.

"Rambusch Downlite" Brochure, received U.S.P.T.O. 10/17/1946.

Catalog by Halo Lighting Division, pp. 19, 40, and 63, 1977 edition.

*Primary Examiner*—Stephen F. Husar

*Attorney, Agent, or Firm*—Dressler, Goldsmith, Shore, Sutker & Milnamow Ltd.

[57] ABSTRACT

A lighting fixture is provided for an inclined surface. The fixture includes a lamp housing for receiving a lamp, and the housing defines a bottom opening for accommodating a baffle. The baffle has a generally cylindrical internal configuration relative to a longitudinal axis. The baffle has an upper open end and a lower open end. The lower open end of the baffle is defined by a plane at an oblique angle relative to the baffle longitudinal axis so as to provide an elliptical aperture which may be disposed parallel to the plane of the sloped ceiling when the fixture is mounted in the sloped ceiling.

24 Claims, 6 Drawing Figures

FIG. 3
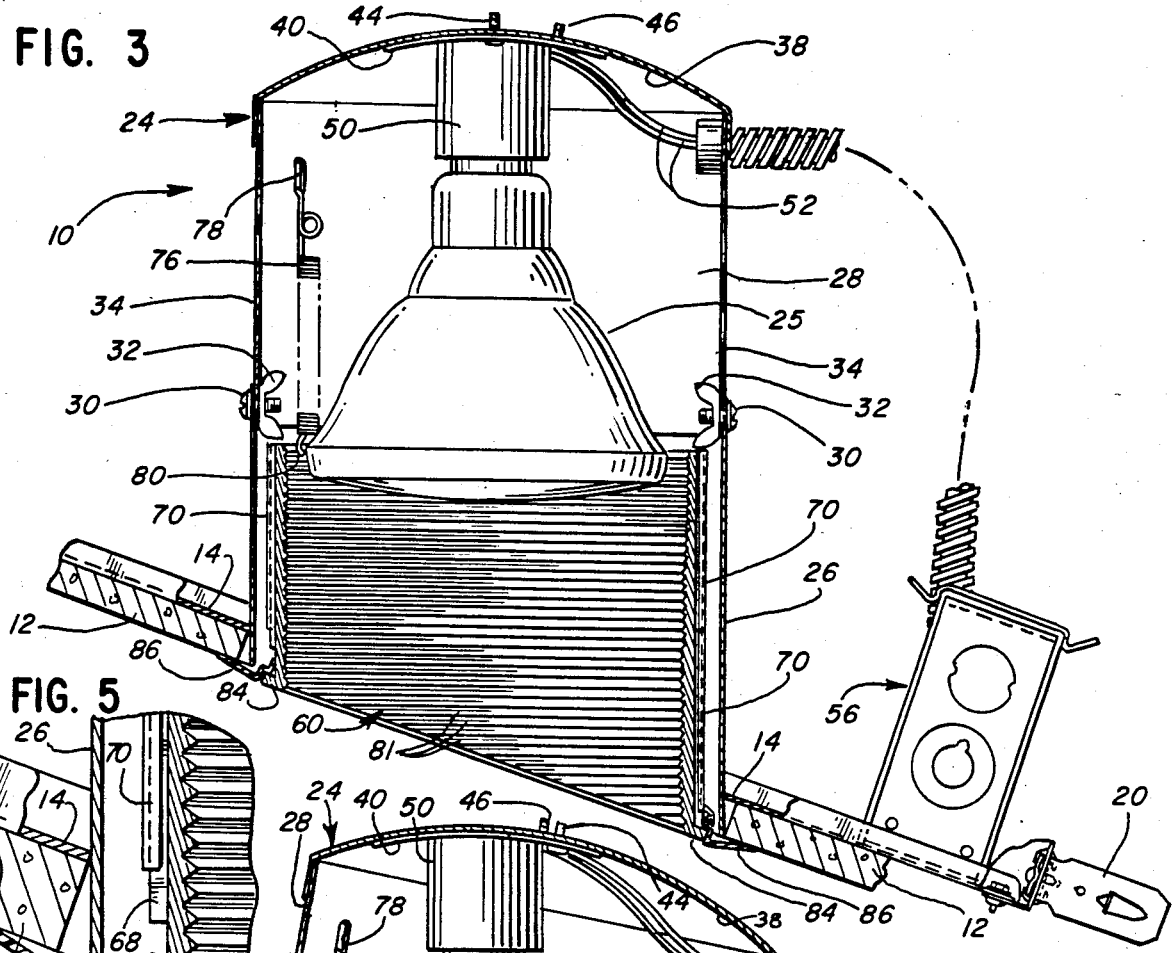
FIG. 5
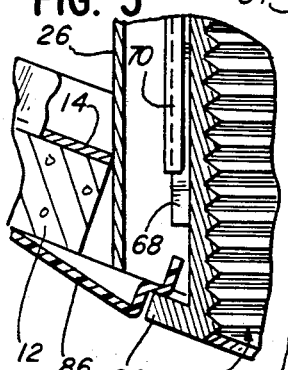
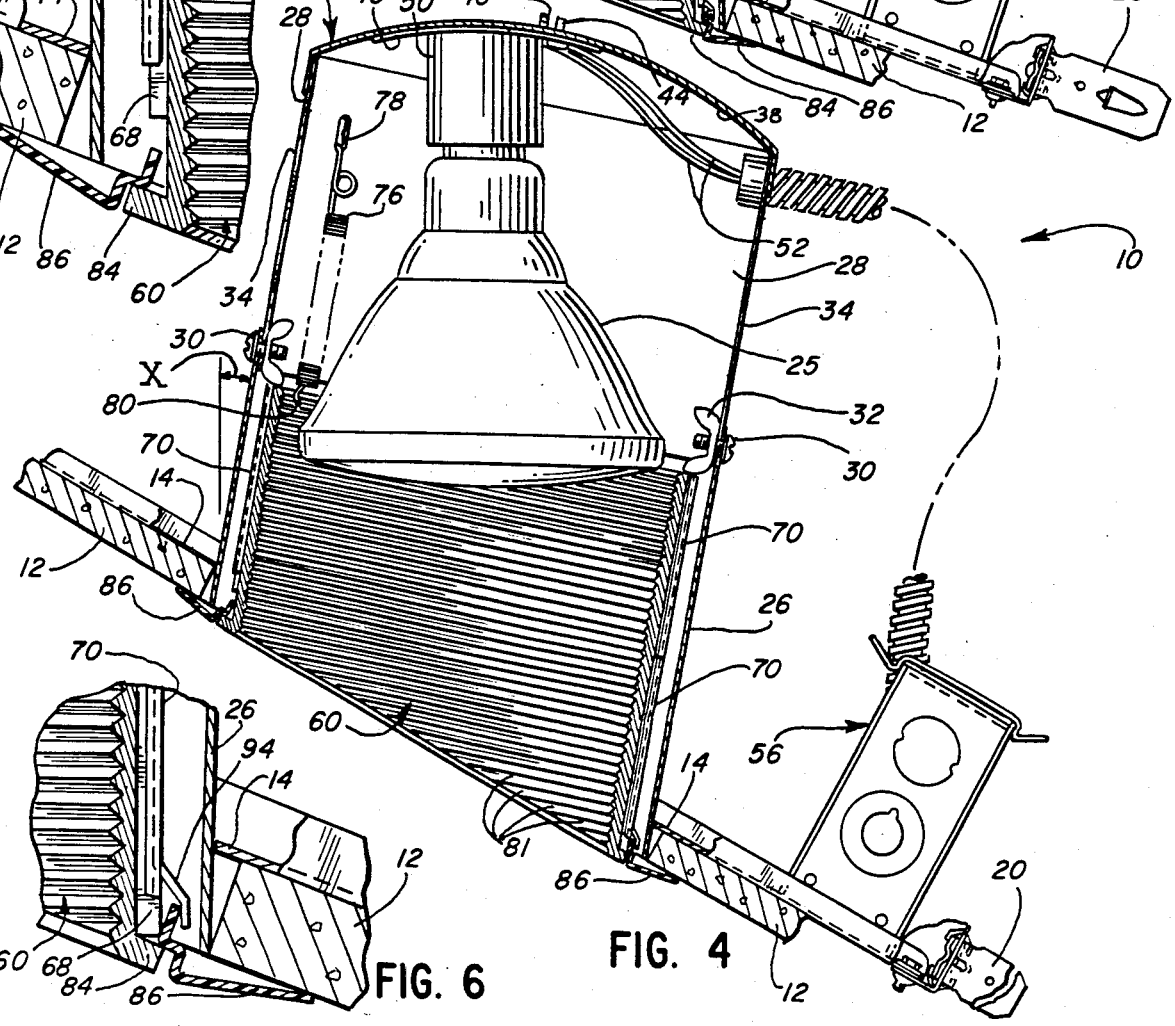
FIG. 6
FIG. 4

SLOPED CEILING RECESSED LIGHT FIXTURE

TECHNICAL FIELD

This invention relates to electrical lighting fixtures and, more particularly, to a recessed lighting fixture for mounting in a sloping or inclined ceiling or other surface.

BACKGROUND OF THE INVENTION AND TECHNICAL PROBLEMS POSED BY THE PRIOR ART

Recessed lighting fixture designs have been proposed for use with sloped ceilings, and such designs have included an adjustable or tilting, partially hemispherical member at the bottom of the fixture. This member is adapted to be oriented at approximately the slope of the ceiling while the remaining portion of the fixture above the member is generally vertically disposed. Other dsigns include a special adapter ring cut at an angle to match the slope of the ceiling.

Although such prior art designs may serve to provide an enclosure around the lamp for matching the sloping ceiling, such prior art designs do not provide the type of lighting effects now desired in many installations. Many conventional fixtures employ a lamp in a housing design in which the lamp is intended to be vertically mounted. These fixtures do not provide the kind of optical performance, brightness control, and cosmetic appearance desired when such fixtures are mounted in a sloped ceiling.

Specifically, while it is usually desired that the light from the lamp within the recessed lighting fixture be directed generally perpendicular to the floor, it is also desirable to have a generally cylindrical internal configuration around and below the lamp. Further, it would be especially desirable to provide fully baffled downlighting wherein light along the interior surface of the fixture would be substantially absorbed so as to eliminate glare and to provide a clean appearance that is aesthetically pleasing.

The present invention lighting fixture overcomes the deficiencies of the prior art by providing the appearance of conventional, non-sloped ceiling downlighting. Its appearance is clean, and it has a minimum of trim. The fixture can be provided with smaller dimensions surrounding the lamp along with controlled brightness and optical characteristics.

SUMMARY OF THE INVENTION

The preferred embodiment of the lighting fixture of the present invention is adapted for recessed mounting in a sloped ceiling. The fixture includes a lamp housing means for receiving a lamp, and the lamp housing means defines a bottom opening.

A baffle is provided at the lamp housing means bottom opening. The baffle has a generally cylindrical internal configuration relative to a longitudinal axis of the baffle.

The baffle has an upper open end and a lower open end. The lower open end is defined by a plane at an oblique angle relative to the baffle longitudinal axis to provide an elliptical aperture which may be disposed parallel to the plane of the sloped ceiling when the fixture is mounted in the sloped ceiling.

Numerous other features of the present invention will become readily apparent from the following detailed description of the invention, from the claim, and from the accompanying drawings.

BRIEF DESCRIPTION OF THE DRAWINGS

In the accompanying drawings forming part of the specification, in which like numerals are employed to designate like parts throughout the same.

FIG. 3 is an enlarged, fragmentary, partial cross-sectional view of the lighting fixture illustrated in FIG. 1;

FIG. 4 is a view similar to FIG. 3 but showing the lighting fixture housing oriented at an angle away from the vertical but with the lamp positioned vertically within the fixture;

FIG. 5 is a fragmentary, greatly enlarged, partial cross-sectional view of a portion of the lower edge of the lighting fixture at the highest elevation of the juncture of the sloped ceiling and the lighting fixture; and FIG. 6 is a view similar to FIG. 5 but showing the lowest elevation of the juncture of the sloped ceiling and lighting fixture.

DESCRIPTION OF THE PREFERRED EMBODIMENT

While this invention is susceptible of embodiment in many different forms, this specification and the accompanying drawings disclose only one specific form of an example of the use of the invention. The invention is not intended to be limited to the embodiment so described, and the scope of the invention will be pointed out in the appended claims.

For ease of description, the lighting fixture of this invention is described in the normal (upright) operating position, and terms such as upper, lower, horizontal, etc., are used with reference to this position. It will be understood, however, that the lighting fixture of this invention may be manufactured, stored, transported, and sold in an orientation other than the position described.

The lighting fixture of this invention includes certain conventional components the details of which, although not fully illustrated or described, will be apparent to those having skill in the art and an understanding of the necessary functions of such components.

Figure 1:
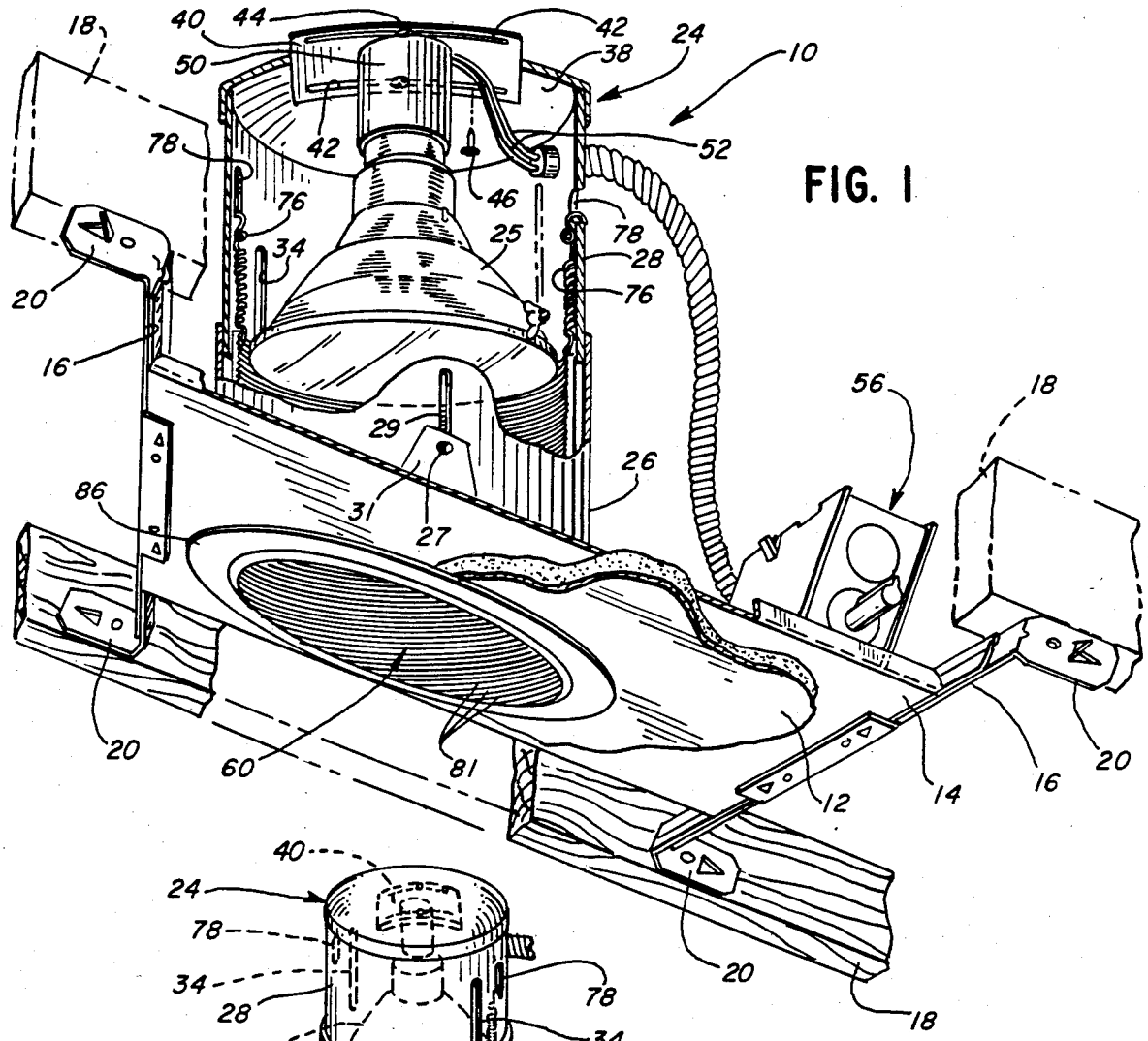
FIG. 1 is a fragmentary, simplified, perspective view of the lighting fixture of the present invention with portions broken away to better illustrate interior detail.

Referring now to the drawings in greater detail, there is illustrated in FIG. 1 a recess mounted lighting fixture 10. The fixture 10 is specifically adapted for mounting in an inclined or sloped ceiling 12. The fixture 10 includes a mounting frame 14 which is typically 22 gauge dieformed, baked, enamel steel. The frame 14 may be provided with bar hangers 16 at both ends for mounting the frame 14 to the ceiling joists 18 by means of integral fastener flanges 20.

The fixture 10 includes a lamp housing means 24 for receiving a lamp 25. The lamp housing means 24 may be cylindrical as shown in the illustrated preferred embodiment and may include a lower housing 26 mounted to the frame 14 and an upper housing 28 telescopically received in the lower housing 26. If desired, these housings could instead be fabricated in a non-telescopic configuration and could even be fabricated as a single piece. The housing means 24, whether consisting of one or more than one housing, could also have a non-cylindrical configuration.

Figure 2:
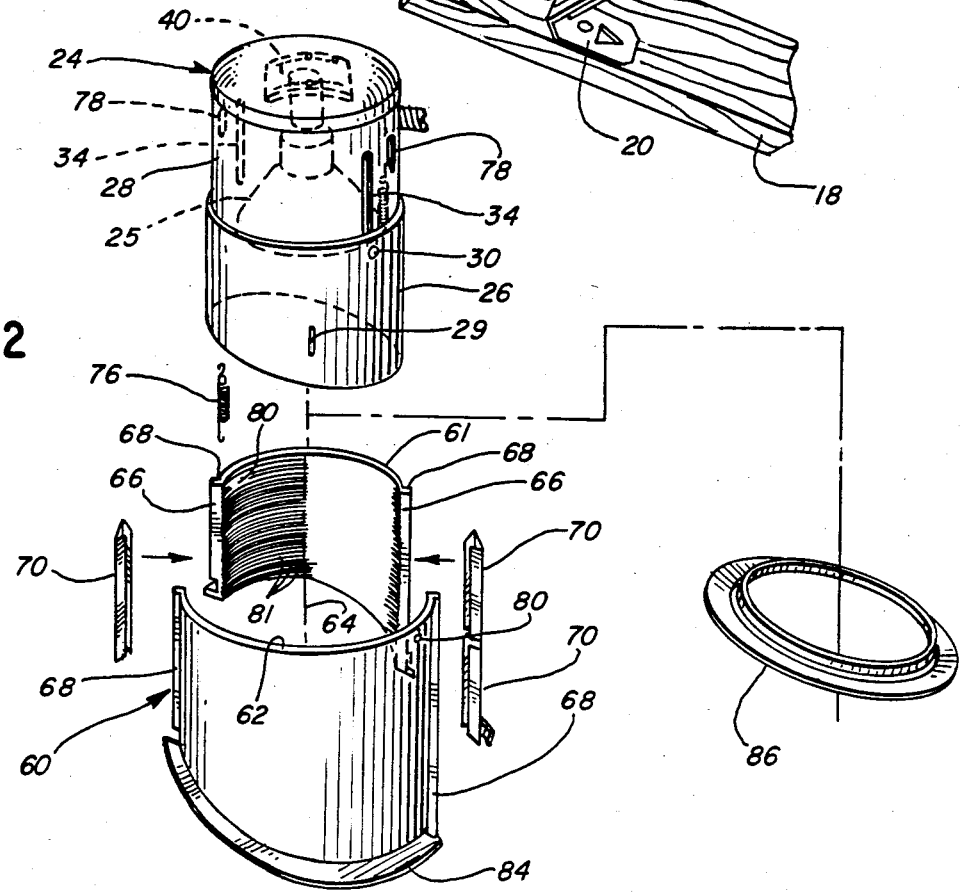
FIG. 2 is a somewhat reduced, exploded, perspective view of interior components of the lighting fixture of the present invention.

Preferably, as best illustrated in FIGS. 1, 2, and 3, the upper housing 28 is secured to the lower housing 26 with two screws 30 and associated wing nuts 32. Each screw 30 is mounted in a suitable aperture in the lower housing 26 and extends through a slot 34 in the upper housing 28. The vertical elevation of the upper housing 28 may thus be adjusted relative to the lower housing 26 so as to accommodate various construction conditions, such as the use of conventional 2×10 joist construction or 2×8 joist construction.

The lower housing 26 may be secured to the plate 14 by suitable means, such as with screws 27 which extend through adjustment slots 29 in the housing 26 and are mounted to ears 31 on the plate 14. The housings 26 and 28 are aligned in concentric registration and are disposed at an angle to the support frame 14.

The lower end of the lower housing 26 has a bottom opening, and the upper end of the upper housing 28 is closed. In the preferred embodiment illustrated, the closed upper end of the upper housing is generally dome shaped and has a downwardly concave arc configuration or a surface 38. If desired, the closed upper end may have other configurations, including a generally flat configuration.

A plate 40 is provided for being secured to the arcuate surface 38 of the lamp upper housing 28. The plate 40 has a downwardly concave arc configuration generally matching that of the closed upper end of the upper housing 28. The plate 40, as best illustrated in FIG. 1, includes a pair of parallel slots 42. A screw 44 is provided for each slot 42. Each screw 44 is positioned with its head engaging the downwardly facing surface of the plate 40 at the margins of the slot 42. The shank of the screw 44 extends through the slot 42 and into threaded engagement with the closed upper end of the upper housing 28. A third screw 46 may also be provided in one of the slots 42 to provide additional means for holding the plate 40 within the upper housing 28.

A socket for receiving the lamp 25 is mounted to the plate 40. Current is supplied to the socket of 50 via electrical wiring 52 coupled between the socket 50 and an electrical junction box 56 that is mounted on the plate 14 and that is supplied with electrical power by additional wiring (not shown) connected to a power source.

As best illustrated in FIGS. 2 and 3, a baffle 60 is provided at the bottom opening of the lower housing 26. The baffle 60 has a generally cylindrical internal configuration relative to its longitudinal axis 64 (FIG. 2).

In the preferred embodiment illustrated, the baffle 60 comprises two generally semi-cylindrical baffle pieces 61 and 62 which are adapted to mate together along a median parting plane containing the longitudinal axis 64 of the cylinder that is formed when the two pieces 61 and 62 are together. Each baffle piece 61 and 62 has two spaced-apart, radially oriented, flat walls 66. Each baffle piece 61 and 62 also has two ribs 68 which each extend parallel to the longitudinal axis 64. One of the ribs 68 of each baffle piece extends from one of the flat walls 66, and the other of the two ribs 68 of the baffle piece extends from the other of the flat walls 66.

The baffle pieces 61 and 62 are held together along the ribs 68 by means of spring clips 70 which each have a generally C-shaped configuration (when viewed from the top end as in FIG. 2).

The baffle 60 has an upper open end and a lower open end. The lower open end is defined by a plane at an oblique angle relative to the baffle longitudinal axis 64 to provide an elliptical aperture which may be disposed parallel to the plane of the sloped ceiling 12 when the fixture 10 is mounted in the sloped ceiling 12.

Owing to the oblique angle defined by the bottom of the baffle 60, one side of the baffle 60 is longer (the right-hand side as viewed in FIGS. 2–4) than is the other side (the left-hand side as viewed in FIGS. 2–4). In view of this, the baffle pieces 61 and 62 are held together on the longer side with two clips 70 while the pieces 61 and 62 are held together on the shorter side with one clip 70.

The entire baffle 60, comprising the assembly of the clipped-together pieces 61 and 62, is suspended from the upper housing 28 by tension springs 76 as best illustrated in FIG. 1. Preferably, two tension springs 76 are employed. The upper end of each tension spring 76 is received in an appropriate slot or aperture 78 in the upper housing 28. The lower end of each tension spring 76 is received in an appropriate aperture 80 (FIG. 2) in the baffle piece 61 or 62. This permits the baffle 60 to be positioned downwardly by an amount sufficient to project slightly below the lower surface of the ceiling 12 as best illustrated in FIGS. 1 and 3.

Preferably, each baffle piece 61 and 62 has a generally smooth exterior cylindrical surface but has a plurality of internal grooves 81 circumferentially disposed on the inside. Each groove 81 is disposed in a plane generally perpendicular to the baffle longitudinal axis 64. The grooves 81 are preferably uniformly spaced along the baffle longitudinal axis 64. The baffle pieces 61 and 62 could also be fabricated with vertical grooves instead of circumferential grooves, or the pieces could be provided without any grooves at all.

As best illustrated in FIG. 2, each baffle piece 61 and 62 also preferably includes an outwardly extending semi-elliptical flange 84. When the baffle pieces 61 and 62 are placed together, the semi-elliptical flanges 84 form a full elliptical flange. The flange 84 on each piece 61 and 62 is adapted to receive a trim ring 86. As best in the cross-sectional view in FIGS. 3–6, the trim ring 86 is elliptical and includes an elliptical recess for receiving the flanges 84 of the baffle pieces 61 and 62. As best illustrated in the enlarged details in FIGS. 5 and 6, the baffle 60, under the urging of the tension springs 76, retains the trim ring 86 against the underside of the ceiling 12.

As best illustrated in FIG. 6, the trim ring 86 is also preferably held against the top of the flange 84 of the baffle 60 by the lower clip 70 which has a downwardly slanting tab 94 that engages the upstanding peripheral wall of the trim ring 86. This prevents the trim ring 86 from rotating on the baffle 60.

In the preferred embodiment illustrated, the lower open end of the baffle 60 is defined by a plane at an oblique angle relative to the longitudinal axis 64, and the bottom opening of the lower housing 26 is also defined by a plane at the same oblique angle relative to the longitudinal axis 64 (FIG. 2). Preferably, the fixture 10 is fabricated in a plurality of different diameter sizes with the openings of the lower housing and baffle oriented at a plurality of oblique angles commonly encountered in sloped ceilings. One such particular diameter and angle combination is illustrated for the preferred embodiment in the figures. FIG. 3 shows the fixture 10 disposed generally vertically in the ceiling 12 while the bottom of the fixture is disposed at an angle matching the ceiling slope angle so that the light from the lamp 25 is directed generally perpendicular to the floor.

If the slope of the ceiling 12 is somewhat less or somewhat greater than illustrated in FIG. 3, then the same fixture 10 can nevertheless accommodate the situation as best illustrated in FIG. 4. In FIG. 4 the ceiling 12 has a greater slope than in FIG. 3. However, the same fixture 10 can be installed, but at a slight angle X relative to the vertical. That is, the support frame 14 is placed parallel to, and substantially flat against, the more greatly inclined ceiling 12, and this necessarily causes the baffle 60 and housing means 24 to be tilted away from the vertical by the angle X. However, in accordance with one of the aspects of the present invention, the lamp 25 can be adjusted within the fixture 10 so that the light from the lamp 25 is directed generally perpendicular to the floor. The lamp 25 is moved to the generally vertical orientation illustrated in FIG. 4 by loosening the screws 44 and 46, moving the plate 40 relative to the arcuate surface 38 of the upper housing 28, and then tightening the screws 46 and 44 when the lamp 25 is in the substantially vertical orientation illustrated in FIG. 4.

In one commercial form of the present invention, it is contemplated that the fixture 10 will be fabricated with an angle of about 18½ degrees between the support frame 14 and housing means 24. The fixture will have corresponding oblique angle openings at the bottom of the fixtures. The novel adjustment feature for the lamp 25 will accommodate a total adjustability range of sloped ceiling angles of about 9½ degrees to about 26½ degrees measured from the horizontal.

This range covers ceiling slopes from 2/12 to 6/12 (where the ceiling "slope" is defined as the ratio between (1) the ceiling "rise" (the vertical distance from the top of the wall to the ceiling peak) and (2) the ceiling "run" (one-half of the horizontal distance from one wall face to the opposite wall face)).

The baffle pieces 61 and 62 are preferably molded from thermoplastic material for ease of manufacture and are then clipped together to form the baffle 60. However, it is to be realized that the baffle 60 could be fabricated as a one-piece member and could be fabricated from other materials.

From the foregoing description, it can be seen that a lighting fixture has been provided that can be adapted for use with ceilings or surfaces that are inclined over a wide range of angles. The lighting fixture is relatively easily and inexpensively manufactured and may be relatively easily and quickly installed.

The lighting fixture provides a downwardly directed light that is generally perpendicular to the floor, and the light is baffled to the lower surface of the ceiling. This absorbs light and eliminates glare. It also provides an aesthetically pleasing appearance—an appearance that is also consistent with conventional baffled downlighting fixtures that are used in non-sloped ceilings.

It will be readily observed from the foregoing detailed description of the invention and from the illustrated embodiment thereof that numerous variations and modifications may be effected without departing from the true spirit and scope of the novel concepts or principles of this invention.

What is claimed is:

1. A lighting fixture for recessed mounting in a sloped ceiling which has a downwardly facing ceiling surface and which defines an opening, said fixture comprising:

lamp housing means for receiving a lamp and adapted to be supported from said ceiling, said lamp housing means defining a bottom opening;

a baffle at said lamp housing means bottom opening, said baffle including means for absorbing or blocking incident light, said baffle having a generally cylindrical internal configuration relative to a longitudinal axis of said baffle, said baffle having an upper open end and a lower open end, said lower open end being defined by a plane at an oblique angle relative to said baffle longitudinal axis to provide an elliptical aperture which may be disposed parallel to the plane of the sloped ceiling when said fixture is mounted in the sloped ceiling, said baffle lower open end extending at least to the plane of said ceiling surface about the periphery of the baffle whereby the light transmitted from said lamp is baffled at least to the plane of said ceiling surface; and an elliptical trim ring having an elliptical inner margin around said baffle lower open end, said trim ring being positioned with its inner margin set radially outwardly of the opening in said baffle lower open end but with said trim ring extending from the periphery of said baffle over a portion of said ceiling surface around said ceiling opening for covering the portion of the ceiling opening between the baffle and the ceiling while exposing the baffle lower open end to view from beneath the ceiling and while being shielded by said baffle from direct transmission of light from said lamp to prevent reflected glare off of said trim ring.

2. The fixture in accordance with claim 1 in which said baffle is telescopically received inside said lamp housing means.

3. The fixture in accordance with claim 2 in which said baffle is suspended from said lamp housing means by at least one tension spring.

4. The fixture in accordance with claim 2 in which said baffle upper open end is defined as a circular aperture in a plane perpendicular to said baffle longitudinal axis for receiving at least a portion of said lamp.

5. The fixture in accordance with claim 2 in which said baffle has a generally smooth exterior cylindrical surface.

6. The fixture in accordance with claim 1 in which said baffle includes a plurality of internal grooves circumferentially disposed on the inside of said baffle, each said groove being disposed in a plane generally perpendicular to said baffle longitudinal axis, said grooves being uniformly spaced along said baffle longitudinal axis.

7. The fixture in accordance with claim 1 in which said baffle comprises two generally semicylindrical pieces adapted to mate together along a median parting plane containing said longitudinal axis, each said piece having two spaced-apart, radially oriented, flat walls on said median parting plane.

8. The fixture in accordance with claim 7 in which each said piece of said baffle includes two ribs extending parallel to said baffle longitudinal axis, one of said two ribs of each said piece extending from one of said flat walls of said piece and the other of said two ribs of said piece extending from the other of said flat walls of said piece, said one rib being longer than said other rib.

9. The fixture in accordance with claim 8 in which said baffle includes a spring clip means having a generally C-shaped configuration for receiving one of said ribs of one of said baffle pieces and one of said ribs of the other of said baffle pieces for holding said baffle pieces together.

10. The fixture in accordance with claim 1 in which said baffle is of a molded construction; in which said trim ring is non-unitary with, and separate from, said molded baffle construction; in which said baffle includes an outwardly extending elliptical flange at said baffle lower open end; and in which said trim ring is supported on said flange.

11. The fixture in accordance with claim 10 in which said trim ring includes an elliptical recess for receiving said flange.

12. The fixture in accordance with claim 1 in which said lamp housing means includes:

a closed upper end;

a plate provided for being secured to said lamp housing means closed upper end;

a downwardly opening lamp socket mounted to said plate; and plate mounting means for adjustably mounting said plate to said lamp housing means closed upper end for positioning said lamp socket at an oblique angle relative to said baffle longitudinal axis.

13. The fixture in accordance with claim 12 in which said lamp housing means closed upper end includes a downwardly concave arc configuration;

said plate has a downwardly concave arc configuration; and said plate mounting means includes at least one slot defined in said plate and includes a screw is positioned with its head engaging a downwardly facing surface of said plate at the margins of said slot, said screw shank extending through said slot and into threaded engagement with said lamp housing means closed upper end.

14. The fixture in accordance with claim 1 in which:

said fixture includes a support frame;

said lamp housing means is generally cylindrical; and said lamp housing means includes a lower housing mounted to said support frame and an upper housing telescopically received in said lower housing.

15. The fixture in accordance with claim 14 in which said baffle is secured to said upper housing.

16. The fixture in accordance with claim 1 in which said housing means bottom opening is defined by a plane at an oblique angle relative to said baffle longitudinal axis to provide an elliptical aperture which may be disposed parallel to the plane of the sloped ceiling when said fixture is mounted in the sloped ceiling.

17. A lighting fixture for recessed mounting in a sloped ceiling which has a downwardly facing surface and which defines an opening, said fixture comprising:

lamp housing means for receiving a lamp and adapted to be supported from said ceiling, said lamp housing means having a generally cylindrical internal configuration relative to a longitudinal axis and defining a bottom opening, said lamp housing means having a generally dome shaped closed upper end defining a downwardly concave arc configuration, said lamp housing means including a plate having a downwardly concave arc configuration matching the arc of said housing means closed upper end, said lamp housing means including a downwardly opening lamp socket fixed to said plate, said lamp housing means including plate mounting means for adjustably mounting said plate to, and against, said lamp housing means closed upper end for positioning said lamp socket at an oblique angle to said longitudinal axis of said lamp housing means; and a baffle at said lamp housing means bottom opening, said baffle including means for absorbing or blocking incident light, said baffle having a generally cylindrical internal configuration concentric with said lamp housing means cylindrical configuration, said baffle having an upper open end disposed within and carried by said lamp housing means and having a lower open end, said baffle lower open end extending to at least the plane of said ceiling surface about the periphery of the baffle whereby the light transmitted from said lamp is baffled at least to the plane of said ceiling surface, said lower open end being defined by a plane at an oblique angle relative to said baffle longitudinal axis to provide an elliptical aperture which may be disposed parallel to the plane of the sloped ceiling when said fixture is mounted in the sloped ceiling so that said baffle lower open end is exposed to view from beneath the ceiling.

18. The fixture in accordance with claim 17 in which said baffle upper open end is defined as a circular aperture in a plane perpendicular to said baffle longitudinal axis and is adapted for receiving at least a portion of said lamp.

19. A lighting fixture for recessed mounting in a sloped ceiling comprising:

lamp housing means for receiving a lamp, said lamp housing means defining a bottom opening; and a baffle at said lamp housing means bottom opening, said baffle having a generally cylindrical internal configuration relative to a longitudinal axis of said baffle, said baffle having an upper open end and a lower open end, said lower open end being defined by a plane at an oblique angle relative to said baffle longitudinal axis to provide an elliptical aperture which may be disposed parallel to the plane of the sloped ceiling when said fixture is mounted in the sloped ceiling, said baffle including two generally semicylindrical pieces adapted to mate together along a median parting plane containing said longitudinal axis, each said piece having two spaced-apart, radially oriented, flat walls on said median parting plane.

20. The fixture in accordance with claim 19 in which each said piece of said baffle includes two ribs extending parallel to said baffle longitudinal axis, one of said two ribs of each said piece extending from one of said flat walls of said piece and the other of said two ribs of said piece extending from the other of said flat walls of said piece, said one rib being longer than said other rib.

21. The fixture in accordance with claim 20 in which said baffle includes a spring clip means having a generally C-shaped configuration for receiving one of said ribs of one of said baffle pieces and one of said ribs of the other of said baffle pieces for holding said baffle pieces together.

22. A lighting fixture for recessed mounting in a sloping ceiling comprising:

lamp housing means for receiving a lamp, said lamp housing means defining a bottom opening;

a baffle at said lamp housing means bottom opening, said baffle having a generally cylindrical internal configuration relative to a longitudinal axis of said baffle, said baffle having an upper open end and a lower open end, said lower open end being defined by a plane at an oblique angle relative to said baffle longitudinal axis to provide an elliptical aperture which may be disposed parallel to the plane of the sloped ceiling when said fixture is mounted in the sloped ceiling, said baffle including an outwardly extending elliptical flange at said baffle lower open end; and an elliptical trim ring at said baffle lower open end, said trim ring being supported on said baffle flange.

23. The fixture in accordance with claim 22 in which said trim ring includes an elliptical recess for receiving said flange.

24. A lighting fixture for recessed mounting in a sloped ceiling comprising:

a support frame;

lamp housing means for receiving a lamp, said lamp housing means being generally cylindrical and defining a bottom opening, said lamp housing means including a lower housing mounted to said support frame and an upper housing telescopically received in said lower housing; and a baffle at said lamp housing means bottom opening, said baffle being secured to said upper housing and having a generally cylindrical internal configuration relative to a longitudinal axis of said baffle, said baffle having an upper open end and a lower open end, said lower open end being defined by a plane at an oblique angle relative to said baffle longitudinal axis to provide an elliptical aperture which may be disposed parallel to the plane of the sloped ceiling when said fixture is mounted in the sloped ceiling.

* * * * *